US006592003B2

(12) United States Patent
Silverthorne

(10) Patent No.: US 6,592,003 B2
(45) Date of Patent: Jul. 15, 2003

(54) BUSINESS CARD DISPENSER

(76) Inventor: Robert A. Silverthorne, 8072 S. 1400 E., Sandy, UT (US) 84093

( * ) Notice: Subject to any disclaimer, the term of this patent is extended or adjusted under 35 U.S.C. 154(b) by 0 days.

(21) Appl. No.: 09/964,284

(22) Filed: Sep. 25, 2001

(65) Prior Publication Data

US 2002/0079324 A1 Jun. 27, 2002

Related U.S. Application Data

(60) Provisional application No. 60/234,777, filed on Sep. 25, 2000.

(51) Int. Cl.[7] ..... B65H 1/08
(52) U.S. Cl. ..... 221/60; 206/39.5
(58) Field of Search ..... 221/43, 60, 61, 221/58, 231, 232, 45, 268, 259; 206/39.5, 39.4, 39

(56) References Cited

U.S. PATENT DOCUMENTS

| | | | | | |
|---|---|---|---|---|---|
| 231,863 | A | | 8/1880 | Strattan | |
| 415,457 | A | | 11/1889 | Hart | |
| 877,253 | A | * | 1/1908 | Stump | 206/39.5 |
| 1,040,051 | A | * | 10/1912 | Swihart | 206/39.5 |
| 1,155,737 | A | | 10/1915 | Kinzie | |
| 1,173,843 | A | | 2/1916 | Morten | |
| 1,415,276 | A | | 5/1922 | Terner | |
| 1,537,641 | A | * | 5/1925 | Kristofek | 206/39.5 |
| 3,286,823 | A | | 11/1966 | Gillespie | 206/39 |
| 3,421,658 | A | | 1/1969 | Cooksey | 221/307 |
| 3,710,929 | A | * | 1/1973 | Morales | 206/38.5 |
| 4,790,435 | A | | 12/1988 | Trusty | 206/39.5 |
| 5,938,010 | A | | 8/1999 | Osterbye | 206/38 |
| 6,082,581 | A | | 7/2000 | Anderson et al. | 221/232 |
| 6,155,456 | A | | 12/2000 | Archer | 221/231 |

* cited by examiner

*Primary Examiner*—Kenneth W. Noland
(74) *Attorney, Agent, or Firm*—Robert L. Shaver; Frank J. Dykas; Stephen M. Nipper

(57) ABSTRACT

A cardholder and dispenser including a housing for encasing the plurality of business cards. The housing having an entrance slot for allowing business cards to be inserted into a housing cavity. The housing further having an exit slot opposing the entrance slot for allowing single cards to be advanced out of the invented cardholder. A spring is utilized within the housing to bias the business cards to a position adjacent to the exit slot for easy ejection therefrom.

9 Claims, 4 Drawing Sheets

BUSINESS CARD DISPENSER

PRIORITY

This application claims priority from and incorporates by reference U.S. patent application Ser. No. 60/234,777 filed on Sep. 25, 2000, entitled Business Card Dispenser.

DESCRIPTION

BACKGROUND OF THE INVENTION

1. Field of the Invention

The present invention generally relates to protective cases, and more particularly relates to protective cases used for holding and dispensing business cards and other items.

2. Background Information

It is common for business people to utilize business cards in order to help promote their businesses or professions. These same business cards are further utilized to distribute pertinent addresses, phone numbers, fax numbers, and e-mail information. It is common procedure during initial business meetings for the participants to shake hands and exchange business cards. Traditionally, a person will keep a small number of business cards in a dedicated compartment in his/her wallet/purse/pocket in order to have them handy during scheduled or unexpected meetings. The problem associated with carrying the cards in one's wallet/purse/pocket is that the cards become bent and are sometimes difficult to access, which causes fumbling which may be embarrassing. Additionally, carrying business cards in a wallet/purse/pocket often leads to damage to the cards, for instance creasing or bending of the card's corners.

Various devices for protecting, holding and distributing business cards are known in the prior art. Examples of such are shown in Archer, U.S. Pat. No. 6,155,456, Anderson, U.S. Pat. No. 6,082,581, Gillespie, U.S. Pat. No. 3,286,823, Terner, U.S. Pat. No. 1,415,276, and Trusty, U.S. Pat. No. 4,790,435. These prior art devices lack the advantageous structural features and characteristics associated with the present invention.

SUMMARY OF THE INVENTION

The present invention is a cardholder and dispenser for holding, protecting and assisting in the dispensation of business cards. Likewise, other similar materials, such as tickets, etc. could be dispensed using the present invention. Use of the terms "business cards" and "cards" is intended to include all such materials.

One embodiment of the present invention has a housing having therein a cavity for receiving a stack of business cards. The housing is rectangular tubular in shape, having two pairs of opposing sides, namely a base wall, a top wall, and two side walls. Likewise, this tube has a pair of end openings, namely a first end opening and a second end opening. Being rectangular tubular in shape, the opposing side walls extending generally perpendicularly from the base wall to their juncture with the top wall. It is also preferred that at least one end wall extend generally perpendicularly from the base partially covering said first end opening, this covering resulting in the creation of an exit slot slightly larger than the cross-sectional diameter of a business card, this exit slot in register with the uppermost of said cards located in said cavity.

It is preferred that the top wall have a slot therethrough for allowing a user to manipulate the uppermost business card contained within the cavity. It is preferred that at least one spring means or resilient member be present in the present invention for biasing the stack of cards contained therein against the underside of the top wall.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
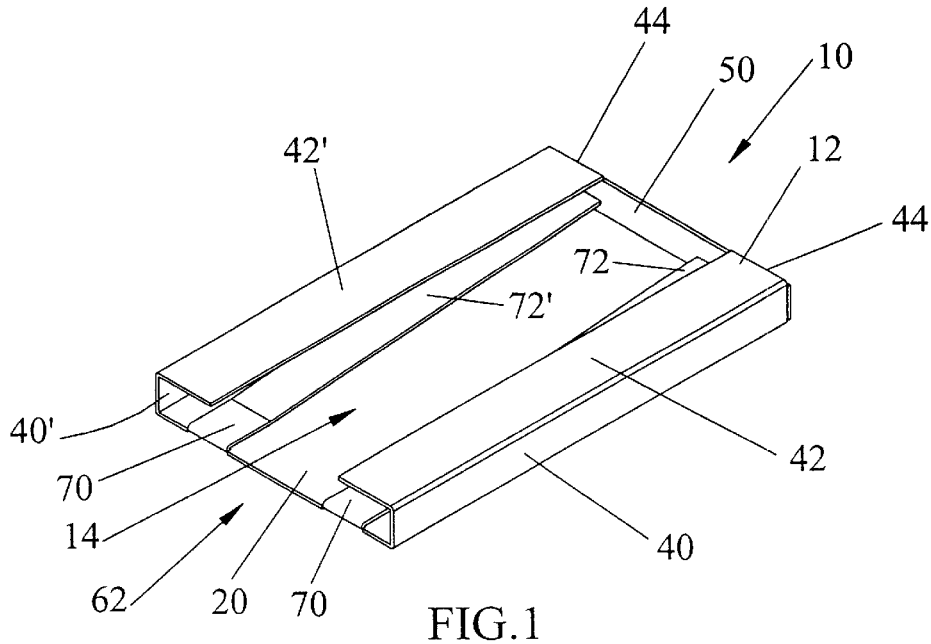
FIG. 1 is a perspective view of one embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Referring initially to FIG. 1, shown is one embodiment of the present invention. The invented cardholder and dispenser 10 is used to hold a stack of business cards and to allow a user to dispense them one at a time. The cardholder 10 has a housing 12 defining a cavity 14 therein. The cards are able to be stored within the cavity 14. The housing 12 has a base 20, a pair of opposing sidewalls 40, 40', a pair of flanges 42, 42' extending from the sidewalls thereby defining a housing top 44, and at least one end wall 50. In the preferred embodiment, the housing top 44 has a slot through the center, as shown in FIG. 1, for allowing a user to manipulate and slide the topmost card out of the cardholder 10.

Figure 3A:
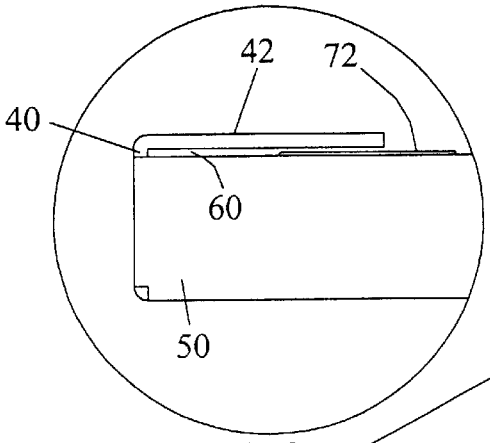
FIG. 3A is a partial view of a portion of FIG. 3.

The end wall 50, the sidewalls 40, 40' and the flanges 42, 42' define an exit slot (as shown in FIG. 3A) through which an individual business card can be selectively manually ejected by the user from the cavity 14. The end of the housing opposite the exit slot comprises an entrance slot 62 through which business cards may be inserted into the cavity. In such a manner, business cards are inserted into a first end via the entrance slot 62 either individually or en masse and said business cards are able to be ejected individually from the second end via the exit slot 60 (shown in FIG. 3A).

Figure 5:
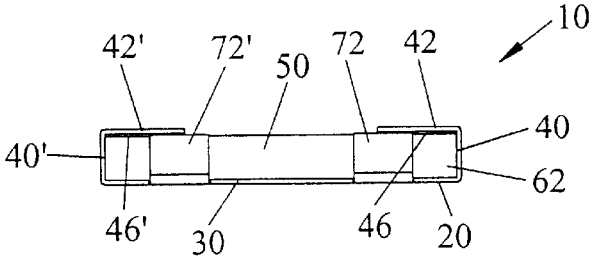
FIG. 5 is a second end view of the embodiment of FIG. 1.

Preferably, present within the housing 12 is at least one resilient member 70 for biasing the stack of cards held within cavity 14 against the inner face of the housing top 44. The inner face 46, 46' is shown in FIG. 5). The resilient member 70 improves the operation of the present invention by allowing the user to easily eject individual cards through the exit slot 60. In the preferred embodiment, the resilient member 70 comprises a pair of tangs 72, 72', which attach at or near the entrance slot 62 end of the housing 12 at the base 20 and extend biased upward towards the inner face of the housing top 44.

Figure 2:
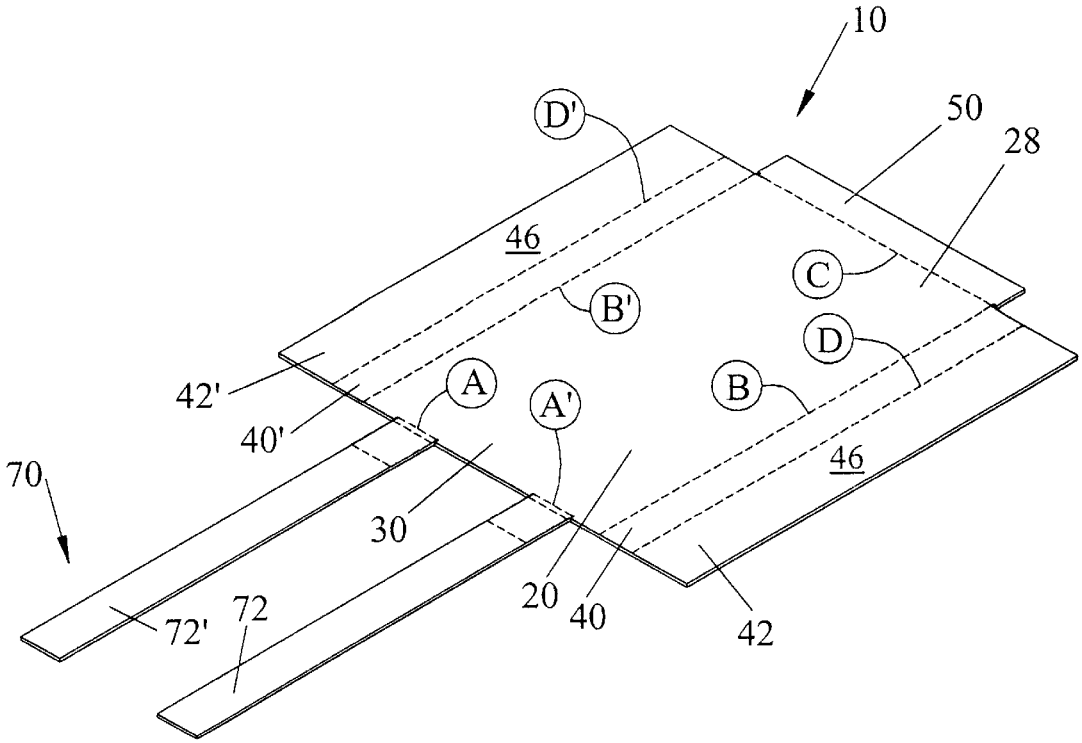
FIG. 2 is a perspective view of a second embodiment of the present invention shown in a disassembled fashion.

Referring now to FIG. 2, shown is a second embodiment of the present invention. This embodiment has a base 20, a pair of sides 26, 26', a first end 28, a second end 30, a pair of side walls 40, 40', a pair of flanges 42, 42', a pair of inner faces 46, 46', a resilient member 70, and a pair of tangs 72, 72'. This embodiment shows one method of manufacturing the present invention. This method of construction may be utilized on the first embodiment as well. This second embodiment is of single piece construction, being formed from a sheet of material such as aluminum or other rigid yet bendable material.

The cardholder 10 would be stamped out of such material in a form similar to what is shown in FIG. 2. First, the tangs 72, 72' would be folded along the lines marked A and A' thereby creating the resilient member or springs. The cardholder 10 would then be folded along the lines B and B' to form a pair of sidewalls. The end wall 50 would then be formed by folding along the line C. Flanges 42, 42' would be created by folding the sidewalls inward along line D. This process would thus create a working embodiment of the present invention similar to the embodiment shown in FIG. 1. Likewise, other methods of manufacturing the present invention, including differing ways of creating the sidewalls, the end wall, the flanges, and the resilient member/spring means, are also anticipated and included in this disclosure.

Figure 3:
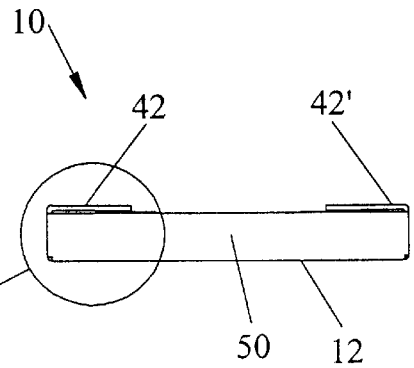
FIG. 3 is a first end view of the embodiment of FIG. 1.

Referring now to FIGS. 3 and 3A, an end view of the embodiment shown in FIG. 1 is shown. In this end view, shown is the end wall 50 extending between the ends of the sidewalls 40, 40' (not shown). Also shown in this figure are the flanges 42 and 42', which form the top of the housing 12. As shown in FIG. 3A, the end wall, sidewalls, and flange cooperate to define an exit slot 60. The exit slot 60 is slightly taller than the thickness of the business card to be contained therein thereby allowing a user to slide a single business card out of the exit slot 60.

Figure 4:
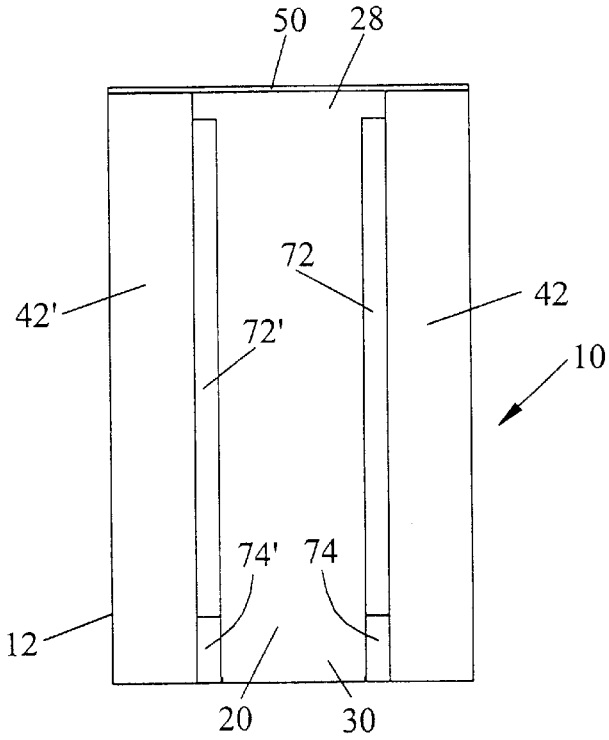
FIG. 4 is a top view of the embodiment of FIG. 1.

Referring now to FIG. 4, a top view of the embodiment of FIG. 1 is shown. This embodiment shows the cardholder 10 having an end wall 50, a first end 28, a second end 30, and a pair of opposing flanges 42 and 42'. As can be seen in this view, the resilient member tangs 72 and 72' are shown therein. As also can be seen, the end of the tangs 72, 72' closest to the second end 30 of the base 20 are rigidly affixed thereto at a connection 74, 74'. The preferred method of affixing the tangs is through use of a press fit with a crimp, however other means of affixing the resilient member to the housing 12 are also envisioned, including the use of adhesives, pins, screws, bolts, nails, and other means.

Referring now to FIG. 5, a second end view of the preferred embodiment of the present invention is shown. This view is shown from the perspective of looking through the entrance slot 62 and into the cavity of the cardholder 10. This view shows the second end 30 of the base, the attachment of the tangs 72, 72' and their biasing upwards and against the inner faces 46, 46' of the respected flanges 42, 42'. These flanges 42, 42' extending generally perpendicular from their respective sidewalls 40, 40', which in turn attach generally perpendicularly to the base 20. The end wall 50 can also be seen through this view.

Figure 6:
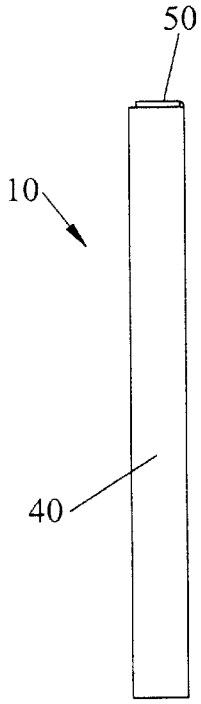
FIG. 6 is a first side view of the embodiment of FIG. 1.
Figure 7:
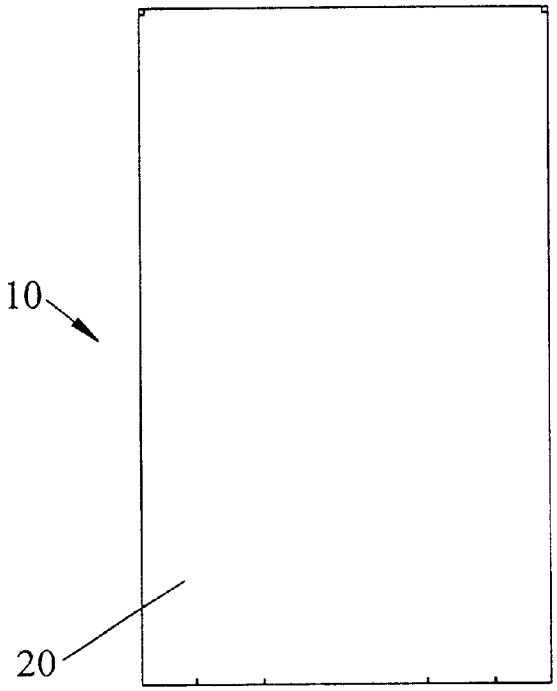
FIG. 7 is a bottom view of the embodiment of FIG. 1.
Figure 8:
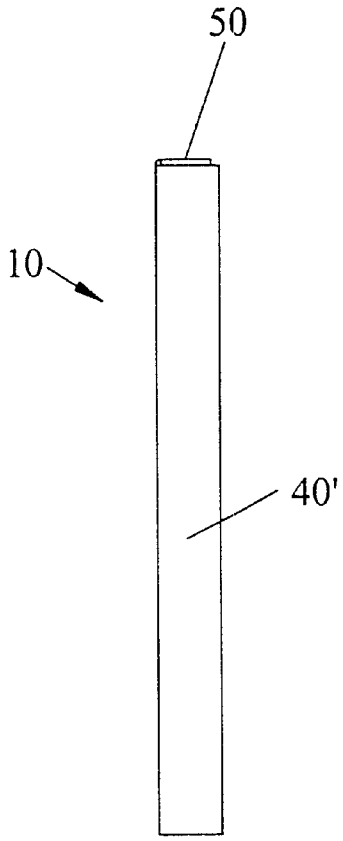
FIG. 8 is a second side view of the embodiment of FIG. 1.

Referring now to FIG. 6, and likewise to the opposite side view in FIG. 8, the sidewall 40/40' and the end wall 50 are likewise shown. The opposite side views (FIG. 6 and FIG. 8) are generally mirror images of one another. Referring now to FIG. 7, shown is a base 20 of the invented cardholder 10.

In the preferred embodiment, the housing is one-half (0.5) of an inch high, three and one-half (3.5) inches long and two (2) inches wide. The preferred spacing between the top flanges 42, 42' is one (1) inch wide, thereby easily allowing a user to slide his/her thumb or finger therebetween for manipulating the uppermost (top) card. The preferred top flanges are one-half (0.5) inch wide. The preferred spring tangs 72, 72' are one-half (0.5) inch wide.

Figure 10A:
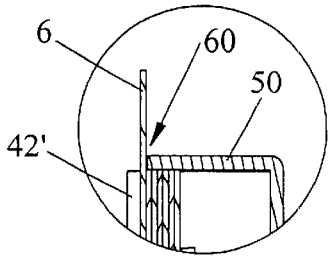
FIG. 10A is a partial view of a portion of FIG. 10.
Figure 9:
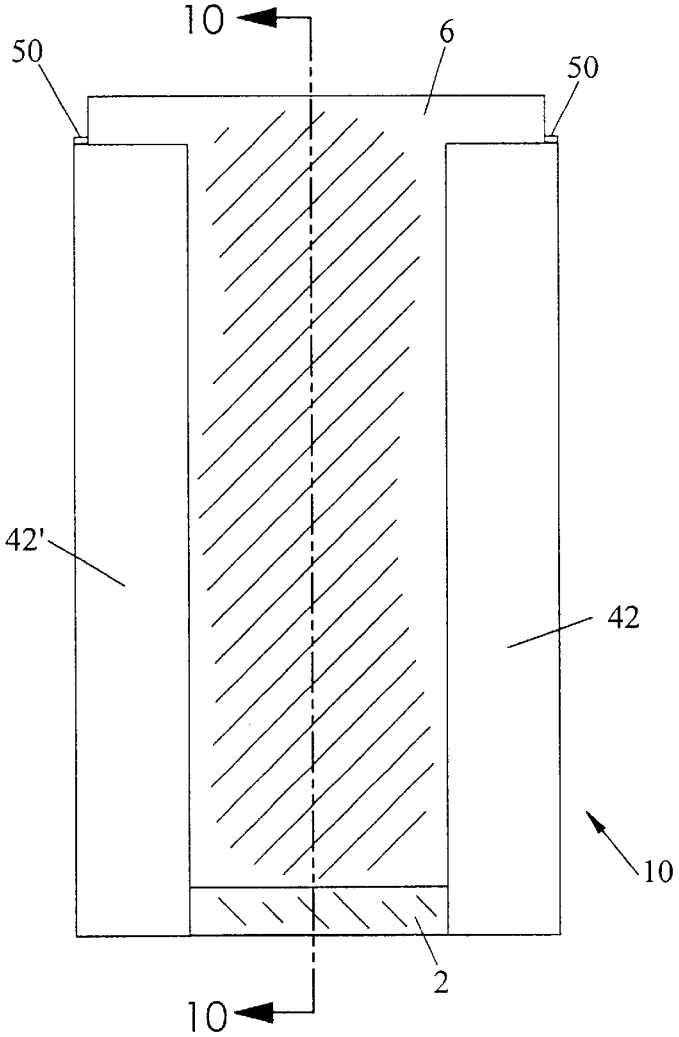
FIG. 9 is a view of one embodiment of the present invention in use.
Figure 10:
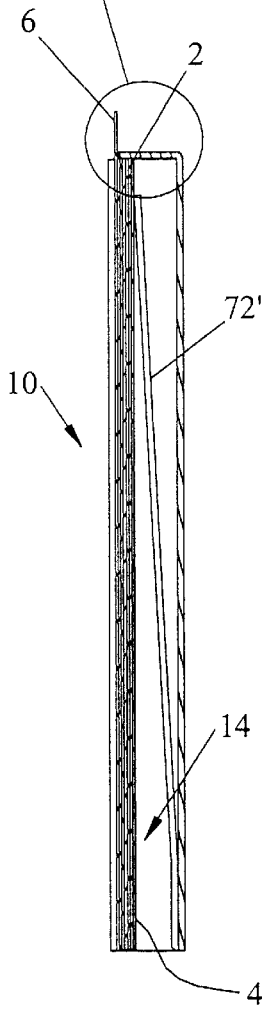
FIG. 10 is a cross-sectional view of FIG. 9 along the line marked 10—10.

Referring now to FIG. 9, a third embodiment of the present invention is shown in use. This view is a top view of the cardholder 10, showing the flanges 42, 42'. The end wall 50 is also visible. An uppermost card 6, as well as at least one other card 2 below the upper most card 6 within the cavity of the cardholder 10, is shown. FIG. 10 is a cross-sectional view of the embodiment shown in FIG. 9 along the indicated lines. In this view, shown is a plurality of cards being held within the cavity 14 of the cardholder 10. These cards being held against the inner face of the housing top, namely the underside of the flange 42 as shown in FIG. 10A particularly. In such a manner, the user is able to extend one of his or her fingers in the space between the flanges 42, 42' producing a positive pressure slightly downwards and forwards (towards the end wall end) against the stack of cards and is able to manipulate and slide the upper most card 6 through the exit slot 60. In such a motion, while the other cards in the cavity may also slide forward towards the end wall 50 of the cardholder 10, the exit slot 60 is configured to be of a size so that only the upper most card is able to actually slide out of the exit slot with the advancing edges of the remaining cards contacting the end wall 50.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A cardholder and dispenser for holding a plurality of stacked cards, said cardholder and dispenser comprising:

a housing having a pair of opposed side walls and a pair of opposed face walls, said opposed side walls generally perpendicular to said opposed face walls thereby defining a cavity for receiving said stacked cards therein, said opposed side walls and said opposed face walls further defining a first end opening and a second end opening;

at least one spring for holding said stacked cards under pressure within said housing;

wherein said plurality of stacked cards may be inserted into said cavity through insertion through said first end opening, and wherein said stacked cards may be removed from said cavity individually through said second end opening, and wherein said housing is formed of a single piece of sheet material, and wherein said sheet material is folded to form said side walls, said spring, said end wall, and said flanges.

2. The cardholder and dispenser of claim 1, wherein said sheet material is aluminum.

3. A cardholder and dispenser comprising:

a housing defining a cavity for receiving a plurality of stacked cards therein, said housing comprising a generally rectangular base having a pair of opposing sides, and a first end opposing a second end;

said housing further comprising a pair of opposing side walls extending generally perpendicularly from said base at said opposing sides and at least one end wall extending generally perpendicularly from said base at said second end;

wherein each of said opposing side walls comprise a generally perpendicular flange extending towards said opposed side wall, said side flanges defining a housing top, said housing top having an inner face facing said cavity;

at least one resilient member attaching to said base at or near said first end, said resilient member extending within said cavity and for engaging the lowermost stacked card to press said stacked cards against the inner face of said housing top;

said end wall being spaced from said housing top, wherein said end wall, housing top and said side walls define an exit slot in register with the uppermost of said cards received within said cavity, and wherein said housing is formed of a single piece of sheet material, and wherein said sheet material is folded to form said side walls, said resilient member, said end wall, and said flanges.

4. The cardholder and dispenser of claim 3, wherein said sheet material is aluminum.

5. The cardholder of claim 3, wherein said housing is formed of a single piece of sheet material, and wherein said sheet material is folded to form said side walls, said end wall, and said flanges.

6. The cardholder and dispenser of claim 5, wherein said sheet material is aluminum.

7. The cardholder of claim 3, wherein said resilient member comprises a pair of tangs extending from said second end towards said inner face of said housing top said tangs for serving as a spring biasing said cards against said inner face.

8. A cardholder and dispenser comprising:

a housing defining a cavity for receiving a plurality of stacked cards therein, said housing comprising a generally rectangular base having a pair of opposing sides, and a first end opposing a second end;

said housing further comprising a pair of opposing side walls extending generally perpendicularly from said base at said opposing sides and at least one end wall extending generally perpendicularly from said base at said second end;

wherein each of said opposing side walls comprise a generally perpendicular flange extending towards said opposed side wall, side flanges defining a housing top, said housing top having an inner face facing said cavity;

said housing further comprising at least one resilient member attaching to said base at or near said first end, said resilient member extending within said cavity and for engaging the lowermost stacked card to press said stacked cards against the inner face of said housing top;

said housing defining an entrance slot opposite said end wall;

said end wall being spaced from said housing top defining an exit slot in register with the uppermost of said cards received within said cavity, wherein said housing is formed of a single piece of sheet material, and wherein said sheet material is folded to form said side walls, said resilient member, said end wall, and said flanges.

9. The cardholder of claim 8, wherein said resilient member comprises a pair of tangs extending from said first end towards said inner face of said housing top said tangs for serving as a spring biasing said cards against said inner face.

* * * * *